US008106350B2

(12) United States Patent
Green et al.

(10) Patent No.: US 8,106,350 B2
(45) Date of Patent: Jan. 31, 2012

(54) CORRECTION OF DEADTIME EFFECTS IN MASS SPECTROMETRY

(75) Inventors: Martin Green, Cheshire (GB); Jason Lee Wildgoose, Stockport (GB); Marc V. Gorenstein, Needham, MA (US)

(73) Assignee: Micromass UK Limited, Manchester (GB)

( * ) Notice: Subject to any disclaimer, the term of this patent is extended or adjusted under 35 U.S.C. 154(b) by 817 days.

(21) Appl. No.: 11/816,643

(22) PCT Filed: Feb. 22, 2006

(86) PCT No.: PCT/GB2006/000613

§ 371 (c)(1),
(2), (4) Date: Aug. 12, 2008

(87) PCT Pub. No.: WO2006/090138

PCT Pub. Date: Aug. 31, 2006

(65) Prior Publication Data

US 2009/0057547 A1 Mar. 5, 2009

Related U.S. Application Data

(60) Provisional application No. 60/657,822, filed on Feb. 25, 2005.

(30) Foreign Application Priority Data

Mar. 4, 2005 (GB) ..... 0504569.5

(51) Int. Cl.
*H01J 49/26* (2006.01)

(52) U.S. Cl. ..... 250/282; 250/281; 250/287; 702/19; 702/28

(58) Field of Classification Search ..... 250/281, 250/282, 286, 287; 702/19, 22, 26, 27, 28
See application file for complete search history.

(56) References Cited

U.S. PATENT DOCUMENTS

| | | | | |
|---|---|---|---|---|
| 6,373,052 | B1 | 4/2002 | Hoyes et al. | |
| 2004/0217275 | A1 * | 11/2004 | Gonin et al. | 250/287 |
| 2006/0015290 | A1 * | 1/2006 | Warburton et al. | 702/178 |
| 2006/0016976 | A1 * | 1/2006 | Land et al. | 250/282 |

OTHER PUBLICATIONS

Stephan et al. "Correction of dead time effects in time-of-flight mass spectrometry", Journal of Vacuum Science Technology A 12(1994) pp. 605-611.*

Hobel, et al; Dead-time and after pulsing correction in multiphoton timing with nonideal detectors; Rev. Scientific Instruments. aip, mELVILLE, ny, us, vol. 65, No. 7, Jul. 1, 1994, pp. 2326-2336, XP000458553, 0734-2101.

Stephan T et al; "Correction of dead time effects in time-of-flight mass spectrometry"; Journal of Vacuum Science & Technology, Part A (Vacuum, Surfaces, and Films), AVS/AIP, Melville, NY, US, vol. 12, No. 2, Mar. 1, 1994, pp. 405-410, XP000442719.

* cited by examiner

*Primary Examiner* — Robert Kim
*Assistant Examiner* — Nicole Ippolito Rausch
(74) *Attorney, Agent, or Firm* — Diederiks & Whitelaw, PLC

(57) ABSTRACT

A method of mass spectrometry is disclosed wherein distortions in a mass spectrum are corrected for by determining or estimating the number of ions $Q_i$ which arrived in an $i^{th}$ time bin, wherein: Formula (I) and wherein $q_i$ is the actual total number of ion arrival events recorded in the $i^{th}$ time bin and x is an integer corresponding to the number of time bins which correspond with an estimated deadtime period.

17 Claims, 10 Drawing Sheets

CORRECTION OF DEADTIME EFFECTS IN MASS SPECTROMETRY

CROSS REFERENCE TO RELATED APPLICATIONS

This application is the National Stage of International Application No. PCT/GB2006/000613, filed on Feb. 22, 2006, which claims priority to and benefit of U.S. Provisional Patent Application Ser. No. 60/657,822, filed on Feb. 25, 2005, and priority to and benefit of United Kingdom Patent Application No. 0504569.5, filed Mar. 4, 2005. The entire contents of these applications are incorporated herein by reference.

BACKGROUND OF THE INVENTION

The present invention relates to a mass spectrometer and a method of mass spectrometry.

U.S. Pat. No. 6,373,052 (Micromass) discloses a method of correcting mass errors in mass spectra recorded by mass spectrometers that record single ion arrival events. The errors arise from a second ion arriving immediately after a first ion such that the electronic data handling and recording system is unable to record the second ion arrival event. The time period during which the electronic data handling and recording system is unable to record a second ion arrival event following a first ion arrival event is known as the deadtime.

The method disclosed in U.S. Pat. No. 6,373,052 comprises measuring the total number of ion arrival events which have been recorded within a known number of spectra for a mass spectral peak at a particular time of flight. An area and centroid correction are then applied to the observed mass spectral peak. The area and centroid correction are obtained from a predetermined correction table. The predetermined correction table is constructed using a plurality of computer simulations which predict the effect of the estimated detector deadtime on simulated mass peaks having peak shape functions approximating the mass spectral peaks to be corrected.

The use of a predetermined correction table enables corrections to be made very rapidly and avoids the need to store large amounts of raw mass spectral data.

The method disclosed in U.S. Pat. No. 6,373,052 however, makes no attempt to correct for distortions in centroid or area due to extending deadtime effects.

An ion arriving at an ion detector will cause the ion detector to suffer from a deadtime period wherein the subsequent arrival of ions during the deadtime period can not be recorded. If ions arrive during the deadtime period but do not extend the overall deadtime period any further then the deadtime is referred to as non-extending deadtime. However, if ions arrive during the deadtime period and cause the overall deadtime period to be extended further then the deadtime is referred to as extending deadtime.

Extending deadtime effects can result in inaccuracies in the reported centroid and area if individual peaks are separated by an amount approaching or less than the deadtime of the ion detector.

In addition, mass spectral peaks first need to be detected and identified before any form of correction procedure can be applied to the mass spectral data. The raw mass spectral data remains distorted and additional information which may be present in the raw mass spectral data such as peak shape information and mass resolution may also be distorted.

It is therefore apparent that peaks in raw distorted mass spectral data need to be detected. The shape and the width of peaks in the raw data will be dependent upon the intensity of the data if distortion due to the deadtime of the ion detector occurs. This may lead to errors in the consistency and accuracy of peak detection which in turn can compromise the consistency and accuracy of any correction applied.

A known method of correcting mass errors in mass spectral data obtained by a Time of Flight mass analyser is disclosed in ORTEC Application note AN57 and Chapter 8 of the ORTEC Modular Pulse-Processing Electronics catalogue. The disclosed method attempts to correct non-extending and extending deadtime effects using multi-channel scalars and time digitisers. These methods of correction are applied to the raw digitised data. The disclosed method does not consider however, that within one time digitisation period corresponding to the shortest time interval over which data may be recorded by the time digitiser used, more than one ion arrival event may occur in an individual time of flight spectrum. Consequently, insufficient intensity correction is applied to the data using the known method. This limits the ability of the known method to correct for deadtime distortions as the event arrival rate increases.

It is therefore desired to provide an improved method of distortion correction.

SUMMARY OF THE INVENTION

According to an aspect of the present invention there is provided a method of mass spectrometry comprising:

(a) acquiring a plurality of sets of mass spectral data wherein ion arrival events are recorded in one or more bins;

(b) summing, combining or histogramming N sets of mass spectral data to form a composite set of data; and (c) at least partially correcting for deadtime effects by determining or estimating the number of ions $Q_i$ which arrived in an $i^{th}$ bin, wherein:

$$Q_i = -\ln\left[1 - \frac{q_i}{N \cdot e^{-\sum_{j=i-x}^{i-1} \frac{Q_j}{N}}}\right] \cdot N$$

and wherein $q_i$ is the actual total number of ion arrival events recorded in the $i^{th}$ bin and x is an integer corresponding to the number of bins which correspond with an estimated deadtime period.

According to the preferred embodiment the ion arrival events are recorded in one or more time, mass or mass to charge ratio bins. Similarly, the $i^{th}$ bin preferably comprises a time, mass or mass to charge ratio bin. The integer x preferably comprises an integer corresponding to the number of time, mass or mass to charge ratio bins which corresponds to an estimated deadtime period.

The step of acquiring the one or more sets of mass spectral data preferably comprises using an axial acceleration or orthogonal acceleration Time of Flight mass analyser.

The method preferably further comprises detecting ions using an ion detector selected from the group consisting of: (i) one or more microchannel plate (MCP) detectors; (ii) one or more discrete dynode electron multipliers; (iii) one or more phosphor, scintillator or photomultiplier detectors; (iv) one or more channeltron electron multipliers; and (v) one or more conversion dynodes. Embodiments are also contemplated wherein the ion detector may comprise a combination of the detector devices disclosed above. For example, according to an embodiment an ion detector may comprise one or more microchannel plate detectors and one or more phosphor, scintillator or photomultiplier detectors.

The step of acquiring one or more sets of mass spectral data preferably comprises using a Time to Digital Converter or recorder to determine the time when ions arrive at an ion detector. The Time to Digital Converter preferably has a sampling rate selected from the group consisting of: (i) <1 GHz; (ii) 1-2 GHz; (iii) 2-3 GHz; (iv) 3-4 GHz; (v) 4-5 GHz; (vi) 5-6 GHz; (vii) 6-7 GHz; (viii) 7-8 GHz; (ix) 8-9 GHz; (x) 9-10 GHz; and (xi) >10 GHz.

The method preferably further comprises the step of ionising a sample using an ion source, wherein the ion source is selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; and (xviii) a Thermospray ion source.

The step of summing, combining or histogramming N sets of mass spectral data preferably comprises forming a histogram or mass spectrum of total number of ion counts or ion arrival events versus time, time bins, mass, mass bins, mass to charge ratio or mass to charge ratio bins.

N is preferably selected from the group consisting of: (i) <100; (ii) 100-200; (iii) 200-300; (iv) 300-400; (v) 400-500; (vi) 500-600; (vii) 600-700; (viii) 700-800; (ix) 800-900; (x) 900-1000; (xi) 1000-5000; (xii) 5000-10000; (xiii) 10000-20000; (xiv) 20000-30000; (xv) 30000-40000; (xvi) 40000-50000; (xvii) 50000-60000; (xix) 60000-70000; (xx) 70000-80000; (xxi) 80000-90000; (xxii) 90000-100000; and (xxiii) >100000.

The integer x is preferably 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50 or >50.

The estimated deadtime period is preferably selected from the group consisting of: (i) <100 ps; (ii) 100-500 ps; (iii) 500-1000 ps; (iv) 1-1.5 ns; (v) 1.5-2.0 ns; (vi) 2.0-2.5 ns; (vii) 2.5-3.0 ns; (viii) 3.0-3.5 ns; (ix) 3.5-4.0 ns; (x) 4.0-4.5 ns; (xi) 4.5-5.0 ns; (xii) 5.0-5.5 ns; (xiii) 5.5-6.0 ns; (xiv) 6.0-6.5 ns; (xv) 6.5-7.0 ns; (xvi) 7.0-7.5 ns; (xvii) 7.5-8.0 ns; (xviii) 8.0-8.5 ns; (xix) 8.5-9.0 ns; (xx) 9.0-9.5 ns; (xxi) 9.5-10.0 ns; and (xxii) >10.0 ns.

The probability of n ions arriving within a single bin within a single acquisition of mass spectral data is preferably given by:

$$P(n) = \frac{e^{-\lambda} \cdot \lambda^n}{n!}$$

wherein n is the total number of ion arrivals in a given bin and λ is the average number of ions arriving in one bin in a final histogrammed spectrum corresponding to N acquisitions.

According to a further aspect of the present invention there is provided a mass spectrometer comprising:

a mass analyser; and a processing system for processing mass spectral data obtained by the mass analyser, wherein the processing system is arranged and adapted to:

(a) acquire one or more sets of mass spectral data wherein ion arrival events are recorded in one or more bins;

(b) sum, combine or histogram N sets of mass spectral data to form a composite set of data; and (c) at least partially correct for deadtime effects by determining or estimating the number of ions $Q_i$ which arrived in an $i^{th}$ bin, wherein:

$$Q_i = -\ln\left[1 - \frac{q_i}{N \cdot e^{-\sum_{j=i-x}^{i-1} \frac{Q_j}{N}}}\right] \cdot N$$

and wherein $q_i$ is the actual total number of ion arrival events recorded in the $i^{th}$ bin and x is an integer corresponding to the number of bins which corresponds to an estimated deadtime period.

The ion arrival events are preferably recorded in one or more time, mass or mass to charge ratio bins. The $i^{th}$ bin preferably comprises a time, mass or mass to charge ratio bin. The integer x is preferably an integer corresponding to the number of time, mass or mass to charge ratio bins which corresponds to an estimated deadtime period.

The mass analyser preferably comprises a Time of Flight mass analyser. The Time of Flight mass analyser preferably comprises an axial acceleration or orthogonal acceleration Time of Flight mass analyser. The Time of Flight mass analyser preferably comprises a pusher and/or pusher electrode for accelerating ions into a time of flight or drift region.

The mass analyser preferably comprises an ion detector. The ion detector preferably comprises an electron multiplier. The ion detector is preferably selected from the group consisting of: (i) one or more microchannel plate (MCP) detectors; (ii) one or more discrete dynode electron multipliers; (iii) one or more phosphor, scintillator or photomultiplier detectors; (iv) one or more channeltron electron multipliers; and (v) one or more conversion dynodes.

The ion detector preferably comprises one or more collection electrodes or anodes. The mass spectrometer preferably further comprises one or more charge sensing discriminators.

The mass spectrometer preferably comprises a Time to Digital Converter. The Time to Digital Converter preferably has a sampling rate selected from the group consisting of: (i) <1 GHz; (ii) 1-2 GHz; (iii) 2-3 GHz; (iv) 3-4 GHz; (v) 4-5 GHz; (vi) 5-6 GHz; (vii) 6-7 GHz; (viii) 7-8 GHz; (ix) 8-9 GHz; (x) 9-10 GHz; and (xi) >10 GHz.

The mass spectrometer preferably further comprises an ion source. The ion source is preferably selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; and (xviii) a Thermospray ion source.

The ion source preferably comprises a pulsed or continuous ion source.

Further aspects of the present invention are contemplated wherein the effects of non-extending deadtime are corrected for.

According to an aspect of the present invention there is provided a method of mass spectrometry comprising:

(a) acquiring one or more sets of mass spectral data wherein ion arrival events are recorded in one or more bins;

(b) summing, combining or histogramming N sets of mass spectral data to form a composite set of data; and (c) at least partially correcting for deadtime effects by determining or estimating the number of ions $Q_i$ which arrived in an $i^{th}$ bin, wherein:

$$Q_i = -\ln\left[1 - \frac{q_i}{\left(1 - \sum_{j=i-x}^{i-1} \frac{q_j}{N}\right) \cdot N}\right] \cdot N$$

and wherein $q_i$ is the actual total number of ion arrival events recorded in the $i^{th}$ bin and x is an integer corresponding to the number of bins which corresponds to an estimated deadtime period.

The ion arrival events are preferably recorded in one or more time, mass or mass to charge ratio bins. The $i^{th}$ bin preferably comprises a time, mass or mass to charge ratio bin. The integer x is preferably an integer corresponding to the number of time, mass or mass to charge ratio bins which corresponds to an estimated deadtime period.

According to a further aspect of the present invention there is provided a mass spectrometer comprising:

a mass analyser; and a processing system for processing mass spectral data obtained by the mass analyser, wherein the processing system is arranged and adapted to:

(a) acquire one or more sets of mass spectral data wherein ion arrival events are recorded in one or more bins;

(b) sum, combine or histogram N sets of mass spectral data to form a composite set of data; and (c) at least partially correct for deadtime effects by determining or estimating the number of ions $Q_i$ which arrived in an $i^{th}$ bin, wherein:

$$Q_i = -\ln\left[1 - \frac{q_i}{\left(1 - \sum_{j=i-x}^{i-1} \frac{q_j}{N}\right) \cdot N}\right] \cdot N$$

and wherein $q_i$ is the actual total number of ion arrival events recorded in the $i^{th}$ bin and x is an integer corresponding to the number of bins which corresponds to an estimated deadtime period.

The ion arrival events are preferably recorded in one or more time, mass or mass to charge ratio bins. The $i^{th}$ bin preferably comprises a time, mass or mass to charge ratio bin. The integer x is preferably an integer corresponding to the number of time, mass or mass to charge ratio bins which corresponds to an estimated deadtime period.

The preferred embodiment relates to a method of correcting distortions in the intensity and mass assignment due to detection deadtime effects in mass spectra recorded by an ion detector in a Time of Flight mass analyser.

The preferred embodiment corrects mass spectral data to account for the finite probability that more than one ion arrival may occur within one time digitisation period corresponding to the shortest time interval over which data may be recorded by the time digitiser used in a single time of flight spectrum.

BRIEF DESCRIPTION OF THE DRAWINGS

Various embodiments of the present invention will now be described, by way of example only, and with reference to the accompanying drawings in which.

DETAILED DESCRIPTION OF THE PREFERRED EMBODIMENTS

Figure 1:
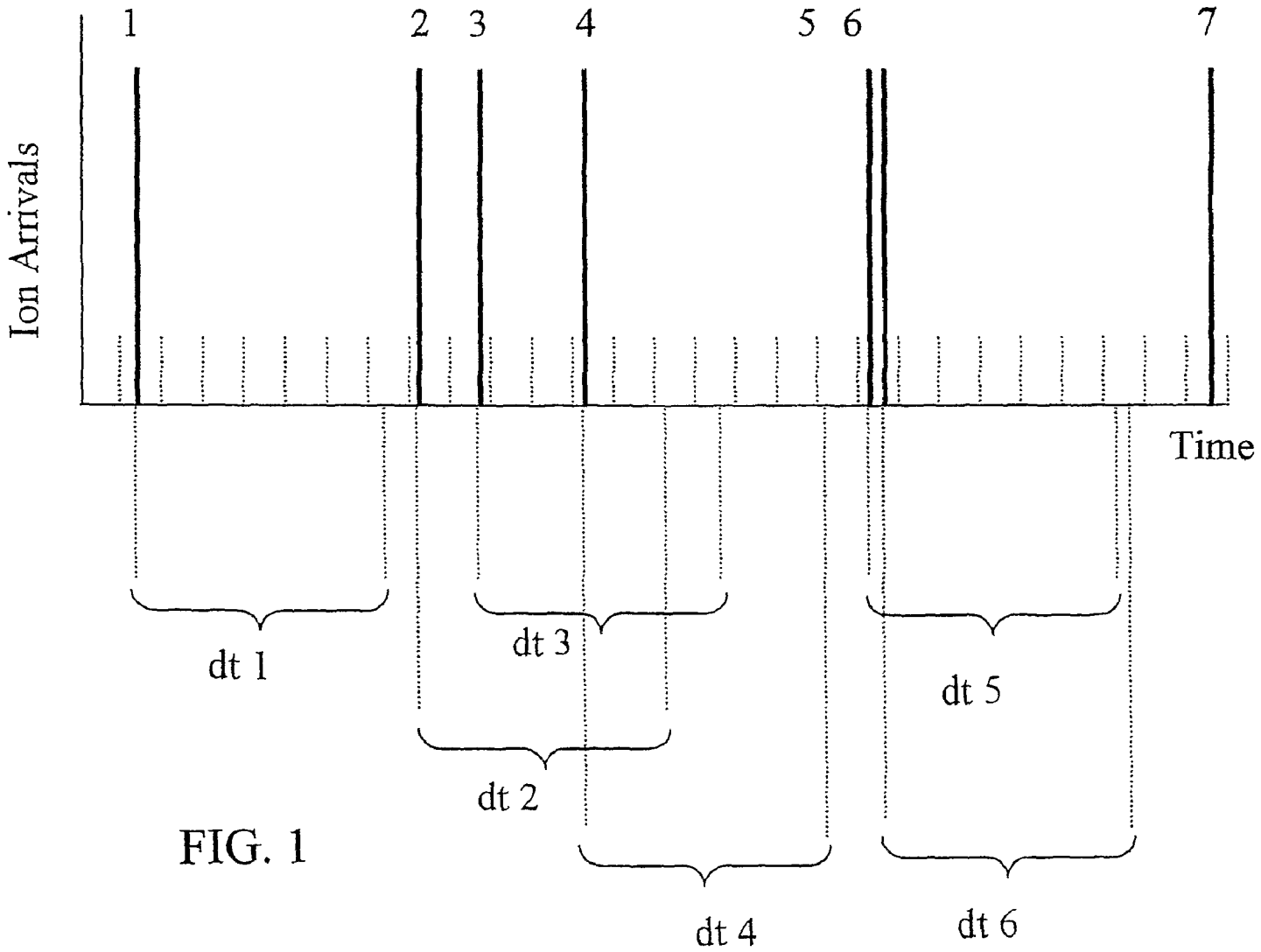
FIG. 1 shows seven ion arrival events over a period of time and the exact deadtime period associated with each ion arrival event.

A preferred embodiment of the present invention will now be described. According to the preferred embodiment a Time of Flight mass analyser is provided which preferably comprises a field free drift region and an ion detector. In one cycle of operation or acquisition a bunch or packet of ions is preferably caused to enter the field free drift region by, for example, being orthogonally accelerated into the field free drift region. The ions in the bunch or packet of ions which are accelerated into the field free drift region are preferably arranged to have essentially the same kinetic energy. As a result, ions having different mass to charge ratios are caused to travel through the field free drift region with different velocities.

Once the ions have traveled through the field free drift region the ions are then preferably arranged to be incident upon the ion detector which is preferably located at the end of the field free drift region. The mass to charge ratio of the ions incident upon the ion detector is preferably determined by determining the transit times of the ions through the field free drift region of the mass analyser measured from the time that the ions were initially accelerated into the field free drift region.

The ion detector may comprise a microchannel plate (MCP) detector or a discrete dynode electron multiplier (or combinations of these devices). Both types of ion detector will generate a bunch of electrons in response to an ion arriving at or being incident upon the ion detector.

The electrons which are generated by the ion detector are preferably collected on or by one or more collection electrodes or anodes which are preferably arranged adjacent the microchannel plate or the discrete dynode electron multiplier. The one or more collection electrodes or anodes are preferably connected to a charge sensing discriminator.

The charge sensing discriminator is preferably arranged to produce a signal in response to electrons striking the collection electrode. The signal produced by the charge sensing discrimination is then preferably recorded using a multi-stop Time to Digital Converter (TDC) or recorder.

The clock of the Time to Digital Converter or recorder is preferably started as soon as a bunch or packet of ions is preferably initially accelerated into the field free drift region of the Time of Flight mass analyser. Events recorded in response to the discriminator output preferably relate to the transit time of the ions through the field free drift region of the Time of Flight mass analyser. A 10 GHz Time to Digital Converter may be used and such a Time to Digital Converter is capable of recording the arrival time of an ion to an accuracy of ±50 ps.

A mass spectrum may then be produced with peak intensities which are representative of the abundances of ion species by obtaining or performing multiple acquisitions and combining or summing the spectra obtained from each acquisition. The individual ion transit times as recorded by the Time to Digital Converter or recorder at the end of each acquisition are then preferably used to produce a final histogram which preferably relates or corresponds to the number of recorded ion arrivals as a function of mass or mass to charge ratio.

Although known Time to Digital Converters are capable of very fast operation, known ion detectors nonetheless suffer from the problem that they exhibit a certain deadtime following an ion arrival event.

During the deadtime following an ion arrival event the ion detector is unable to respond to another ion arriving at the ion detector, i.e. the detector system is unable to record further ions which may arrive at the ion detector during the deadtime period.

The total deadtime of an ion detector and the associated electronics (i.e. the charge sensing discriminator and the Time to Digital Converter) is typically of the order of 5 ns. Under certain conditions it may be relatively likely that some ions will arrive at the ion detector during the combined ion detector, charge sensing discriminator and Time to Digital Converter deadtime during acquisition of a Time of Flight spectrum. As a result these ions will then fail to be detected or recorded.

The failure to detect or record the ions will result in a distortion of the final mass spectrum produced by the mass analyser. This distortion can only be avoided or reduced by either reducing the arrival rate of ions at the ion detector or by post-processing the mass spectral data and then seeking to correct for the effects of the deadtime.

Deadtime effects can either be extending or non-extending in nature. If the ion detector system suffers from extending deadtime then the arrival of an ion during the deadtime period which was initially triggered by an ion arriving at the ion detector will cause the deadtime to be yet further extended. If the ion detector system suffers from non-extending deadtime then an ion arriving during the deadtime period which was initially triggered by an earlier ion arrival event will not be recorded but will not cause the deadtime period to be yet further extended.

Ion detectors used in known Time of Flight mass analysers typically suffer predominantly from extending deadtime effects. The extending deadtime effects are mainly a result of the width of the analogue pulse produced by the electron arrival distribution at the collection electrode or anode. In the following it will be assumed that any non-extending deadtime effects associated with the digitisation rate of the Time to Digital Converter or recorder are negligible and can therefore effectively be ignored.

FIG. 1 shows seven ion arrival events and the deadtime associated with each ion arrival event. Time is represented along the x-axis and the vertical lines represent the time at which ions reach the ion detector. The dotted graduations shown at regular intervals along the x-axis represent the sampling rate of the Time to Digital Converter which was used to record the ion arrival events.

The precise deadtime associated with the first six of the seven ion arrival events is indicated by the deadtime intervals dt1 to dt6.

Figure 2:
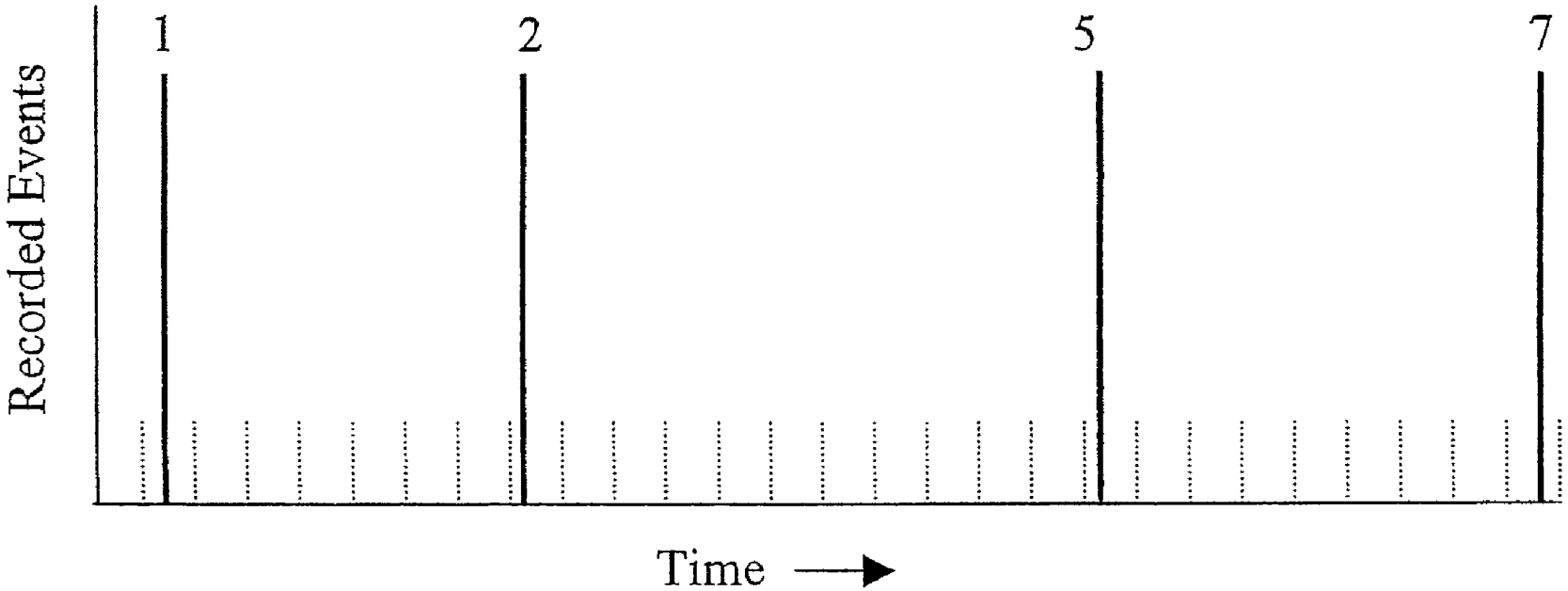
FIG. 2 shows the corresponding Time of Flight spectrum which will be recorded due to the effect of deadtime which will cause some ion arrival events not to be recorded.

FIG. 2 shows a Time of Flight spectrum as would be actually recorded by the mass analyser due to the effects of deadtime causing some of the ion arrival events to be missed. In particular, it is apparent from comparing FIGS. 1 and 2 that the third, fourth and sixth ion arrival events have failed to be recorded because these ion arrival events occur in the deadtime associated with a previous ion arrival event. The spectrum shown in FIG. 2 therefore represents the output from the ion detector and the signal which is then input to a Time to Digital Converter.

Figure 3:
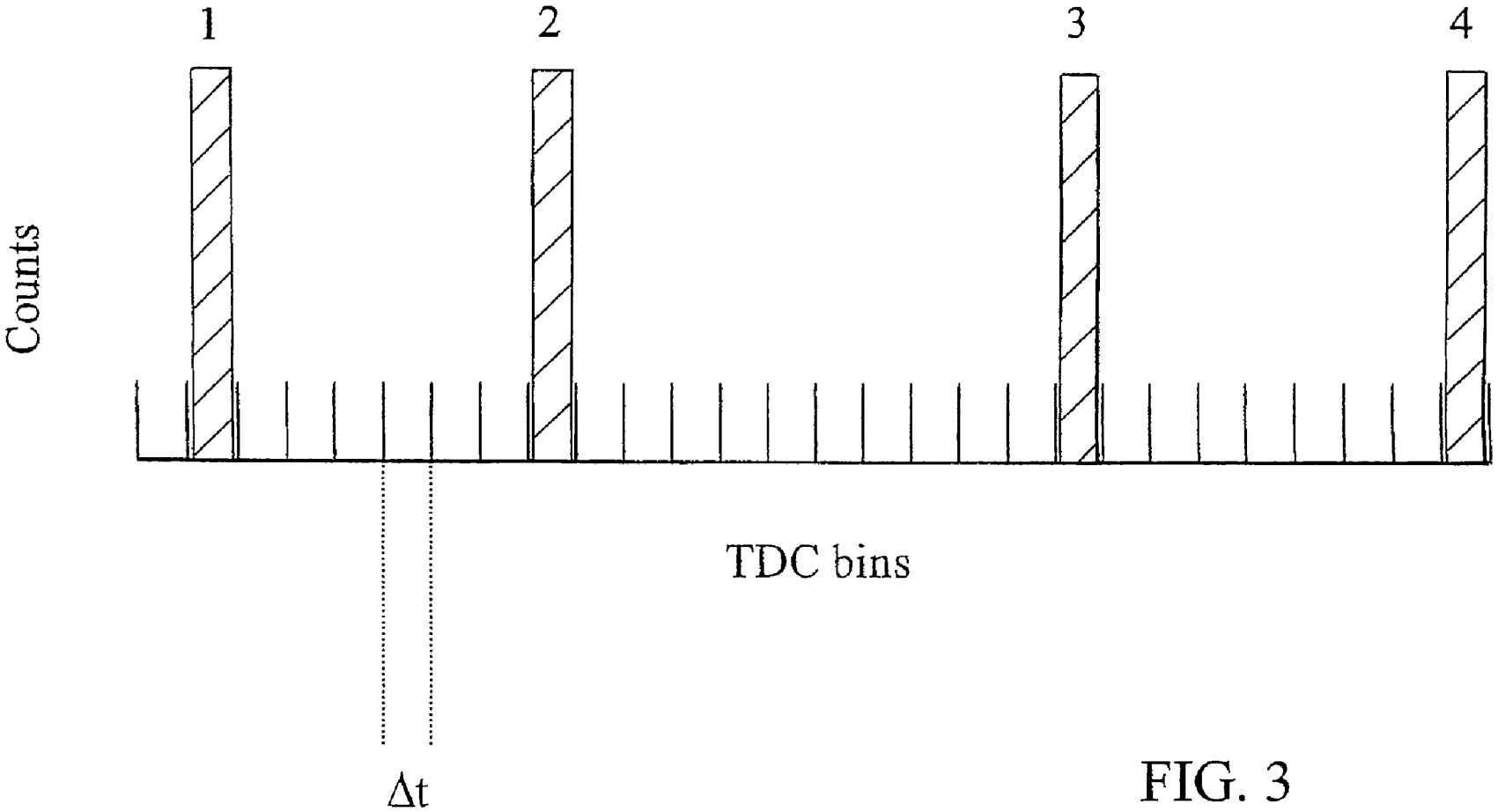
FIG. 3 shows a corresponding Time of Flight spectrum as recorded by a Time to Digital Converter (TDC)

FIG. 3 shows the spectrum as it would be recorded using a Time to Digital Converter with a sampling rate having a time bin width of Δt as shown in FIG. 3. The x axis shown in FIG. 3 now represents time bins.

The arrival time of an ion recorded at a particular time bin i is given by:

$$t=i\cdot\Delta t \tag{1}$$

wherein t is the arrival time and Δt is the width of each time bin.

As is readily apparent from FIG. 3, only four of the seven ion arrival events result in an ion count being recorded.

Figure 4:
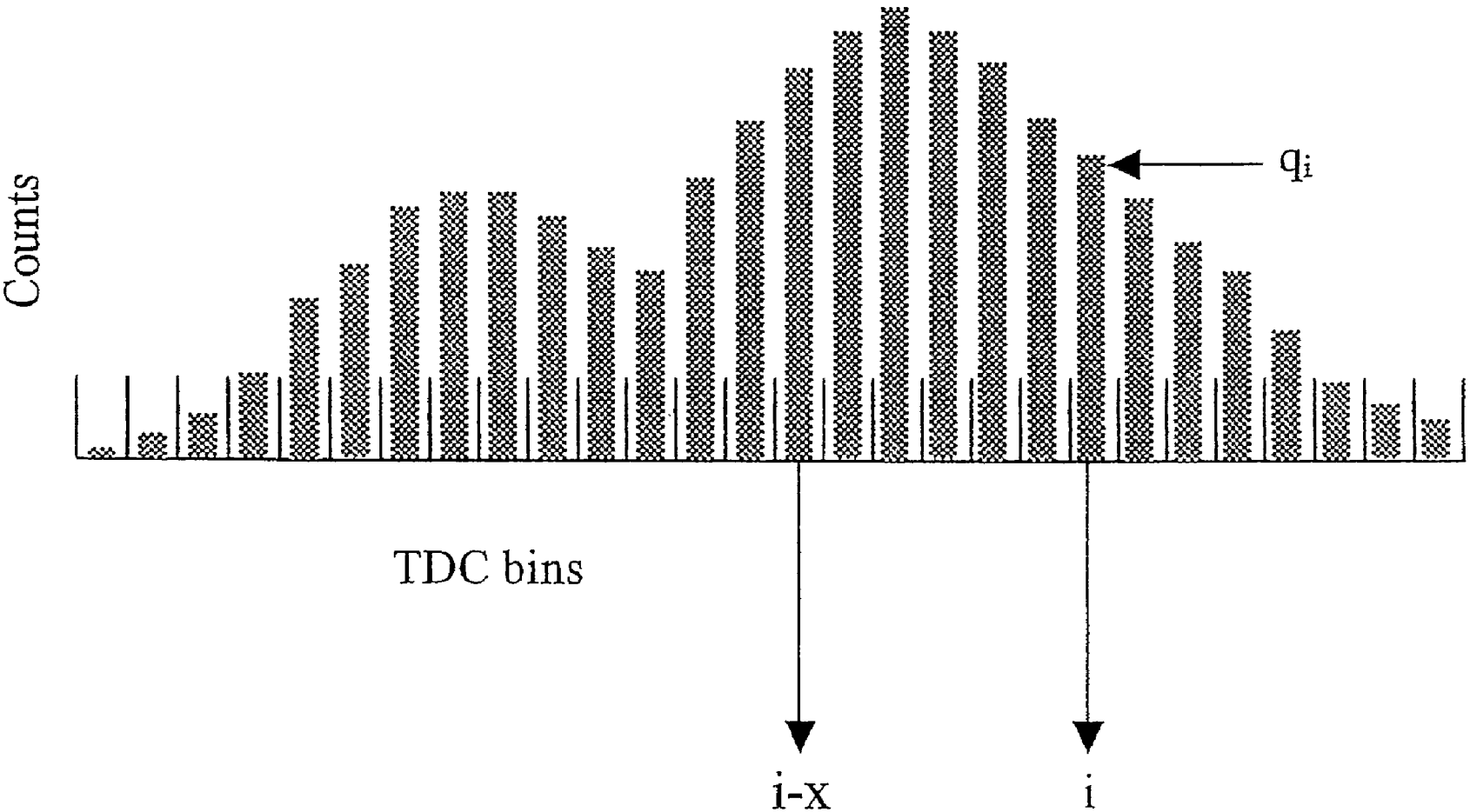
FIG. 4 shows an histogram of multiple Time of Flight spectra combined together to form a composite spectrum.

FIG. 4 shows the result of summing the number of ion counts in each time bin of N separate time of flight spectra or acquisitions. A final histogrammed spectrum is produced.

In the following analysis $Q_i$ represents the theoretical total number of ion counts in the $i^{th}$ time bin if the ion detector did not suffer from deadtime effects i.e. if the deadtime were zero.

In a similar manner $q_i$ represents the actual number of ion counts recorded in the $i^{th}$ time bin. The actual number of ion counts recorded in the $i^{th}$ time bin may be less than the theoretical total number of ion counts $Q_i$ which may be expected to be observed because of deadtime effects. N is the total number of separate time of flight spectra or acquisitions which are summed together to form the final histogrammed spectrum. Finally, x is an integer number of the Time to Digital Converter bin widths Δt rounded up to the next integer value.

The deadtime δt which is used according to the preferred embodiment is given by:

$$\delta t = x \cdot \Delta t \tag{2}$$

wherein x is an integer number of the Time to Digital Converter bin widths Δt rounded up to the next integer value.

Figure 5:
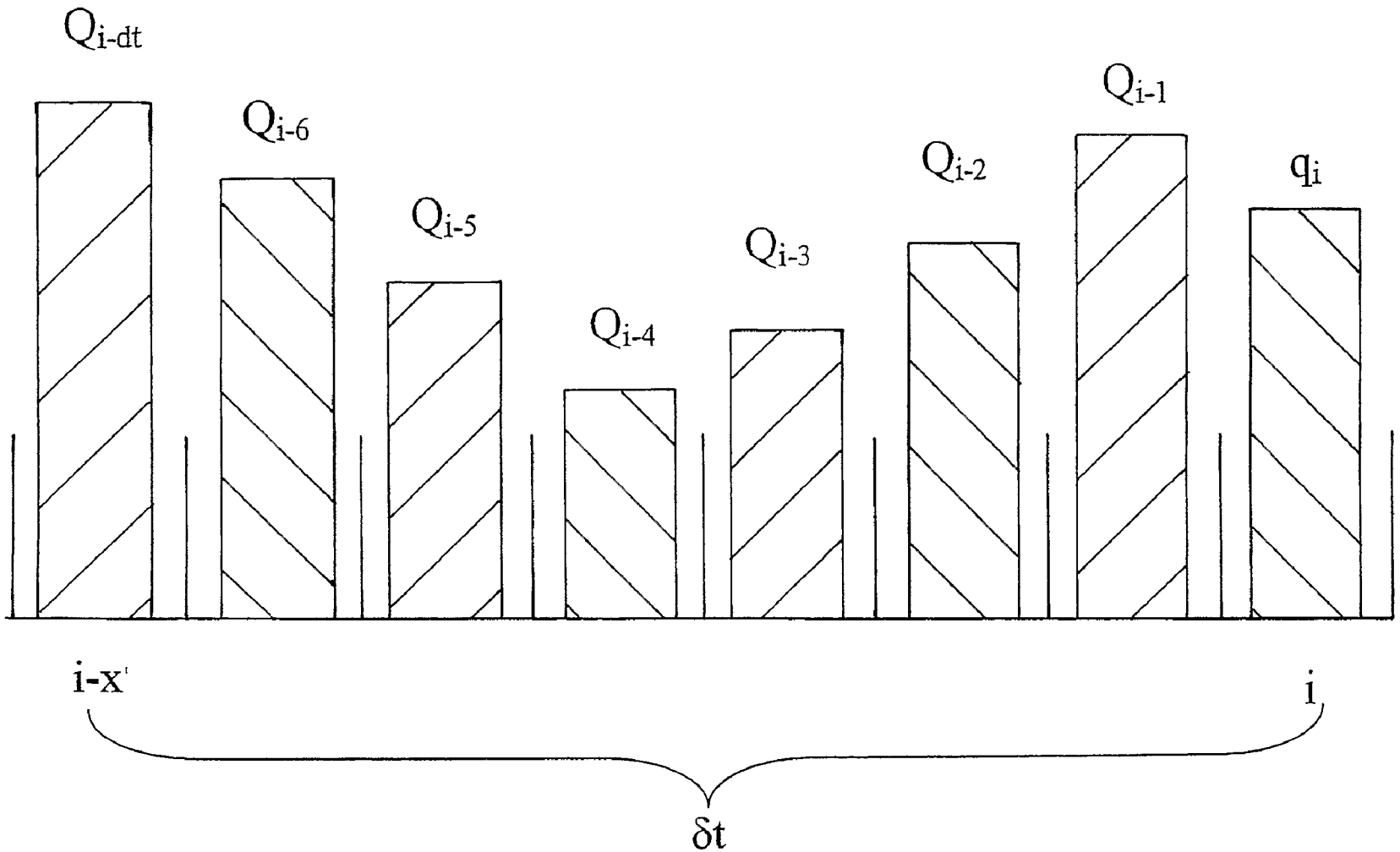
FIG. 5 shows a portion of an histogram across a deadtime interval wherein the histogram is formed by combining a plurality of Time of Flight spectra.

FIG. 5 shows a small portion of a final histogrammed spectrum formed by summing together N separate time of flight spectra. The portion of the final histogramed spectrum shown corresponds with an applied deadtime period δt. In this particular case the applied deadtime period δt equals seven separate time bins (i.e. x equals 7 in Eqn. 2).

The number of events $q_i$ actually recorded in the $i^{th}$ time bin (see right hand side of FIG. 5) can be considered to have been reduced by the effect of extending deadtime due to ion arrivals occurring in the immediately preceding time bins within the range i−x to i−1. It will be appreciated that each and every time an ion arrives at the ion detector and the ion arrival event is recorded by the ion detector in one of the time bins ranging from i−x to i−1, then an ion arrival event cannot then be recorded in the $i^{th}$ time bin.

According to the preferred embodiment a correction is made to account for the distortion (i.e. the reduced number of ions recorded as arriving) in the $i^{th}$ time bin due to the deadtime effect of ions arriving in a prior time bin which is less than the deadtime period away from the $i^{th}$ time bin.

To calculate the correction which is applied according to the preferred embodiment it is firstly assumed that the number of ions arriving in any given time bin is governed by Poisson statistics. Accordingly, the probability of n ions arriving within a single time bin of a single mass spectral data set is given by:

$$P(n) = \frac{e^{-\lambda} \cdot \lambda^n}{n!} \tag{3}$$

wherein n is the total number of ion arrival events in a given time bin and λ is the average number of ions arriving in a time bin of a final histogrammed spectrum formed by summing N separate mass spectral data sets. Furthermore:

$$\lambda_i = \frac{Q_i}{N} \tag{4}$$

wherein $Q_i$ is the total number of ion arrival events which occur in the $i^{th}$ time bin.

In order to record an ion arrival event in a particular time bin i then because of deadtime effects there must not be an ion arrival event in any of the preceding time bins from the immediately previous time bin i−1 through to the earlier time bin i−x.

Given a histogram formed by summing a plurality of sets of mass spectral data and the total number of ion arrival events in the time bin i−x being $Q_{i-x}$, then the probability of recording zero ion arrival events in this time bin can be determined from Equations 3 and 4 by setting n=0 and is given by:

$$P(0)_{i-x} = e^{\frac{-Q_{i-x}}{N}} \tag{5}$$

Therefore, the overall probability P(0) of recording zero ion arrival events in any of the time bins i−x to i−1 prior to the $i^{th}$ time bin is given by:

$$P(0) = \prod_{j=i-x}^{i-1} e^{\frac{-Q_j}{N}} = e^{-\sum_{j=i-x}^{i-1} \frac{Q_j}{N}} \tag{6}$$

The actual or experimentally observed number $q_i$ of ion arrival events in time bin i in the final histogram of N time of flight spectra may have been reduced in proportion to the probability that an ion arrival event occurred in one of the preceding time bins. The probability that an ion arrival event occurred in one of the preceding time bins is 1−P(0).

Accordingly, the number of ion arrival events which would have been recorded in the $i^{th}$ time bin in the absence of deadtime effects due to an ion arrival event occurring in any of the preceding time bins i−x to i−1 is given by:

$$q_i' = \frac{q_i}{e^{-\sum_{j=i-x}^{i-1} \frac{Q_j}{N}}} \tag{7}$$

The expression given in Eqn. 7 gives the corrected number of ion arrival events which are considered likely to have occurred in the $i^{th}$ time bin.

At high ion currents the probability that more than one ion may arrive simultaneously within any one time bin in any time of flight spectra will begin to become significant.

If the determined or estimated number of ion arrival events in the $i^{th}$ time bin after correction according to Eqn. 7 is $q_i'$ then the probability of zero ion arrival events occurring in the $i^{th}$ time bin is given by:

$$P(0)_i = 1 - \frac{q_i'}{N}. \tag{8}$$

Equating this with the probability of zero ion arrival events given by the Poisson statistics in Eqn. 3 then:

$$1 - \frac{q_i'}{N} = e^{-\lambda_i} \tag{9}$$

Therefore:

$$\lambda_i = -\ln\left(1 - \frac{q_i'}{N}\right) \tag{10}$$

The theoretical number of ion arrival events $Q_i$ in time bin i as corrected for deadtime losses and multiple ion arrivals is given (see Eqn. 4) by:

$$Q_i = \lambda_i \cdot N \tag{11}$$

Accordingly, the complete expression for the deadtime correction according to the preferred embodiment can be determined by substituting Eqns. 7 and 10 into Eqn 11 giving:

$$Q_i = -\ln\left[1 - \frac{q_i}{N \cdot e^{-\sum_{j=i-x}^{i-1} \frac{Q_j}{N}}}\right] \cdot N \quad (12)$$

It will be noted that Eqn. 12 requires that the same calculation has already firstly been carried out on time bins i−x to i−1 in order to determine the corrected number of ion arrival events $Q_{i-x}$ to $Q_{i-1}$ in these time bins. The preferred correction method therefore preferably corrects ion arrival events for each time bin in a progressive manner from the first time bin to the last time bin. According to the preferred embodiment the mass spectral data may be arranged such that the number of ion arrival events in at least the first n time bins (wherein n=x) is either zero or very low.

A Monte Carlo software model was used to model the ion arrival time distribution and mean ion arrival rate in a Time of Flight mass analyser. The model was used to evaluate the effectiveness of the deadtime correction method according to the preferred embodiment.

The number of ion arrival events n in a single mass spectral peak in one time of flight spectrum was assumed to follow a Poisson distribution at a specified mean arrival rate λ. Randomly generated events were assigned time of arrivals from a Gaussian distribution with a mean representing the mean arrival time at the ion detector and a standard deviation indicative of the mass resolution of the simulated mass spectral peak or peaks. Each individual series of events generated in this way were sorted to exclude events which fall within a specified deadtime after preceding events. A total of $10^6$ individual spectra were generated in this way. These were then sorted into a final histogram with a fixed time bin width.

The final histogram was subjected to the correction algorithm according to the preferred embodiment and also to a known correction algorithm in order to compare the approach according to the preferred embodiment with the known approaches. For comparison an undistorted data set was produced from the simulation wherein the deadtime period was set to zero. The ratio of the number of ion arrival events in the deadtime distorted data before and after correction divided by the total number of ion arrival events as determined from the undistorted (deadtime=zero) data was determined for different ion mean arrival rates λ.

Figure 6:
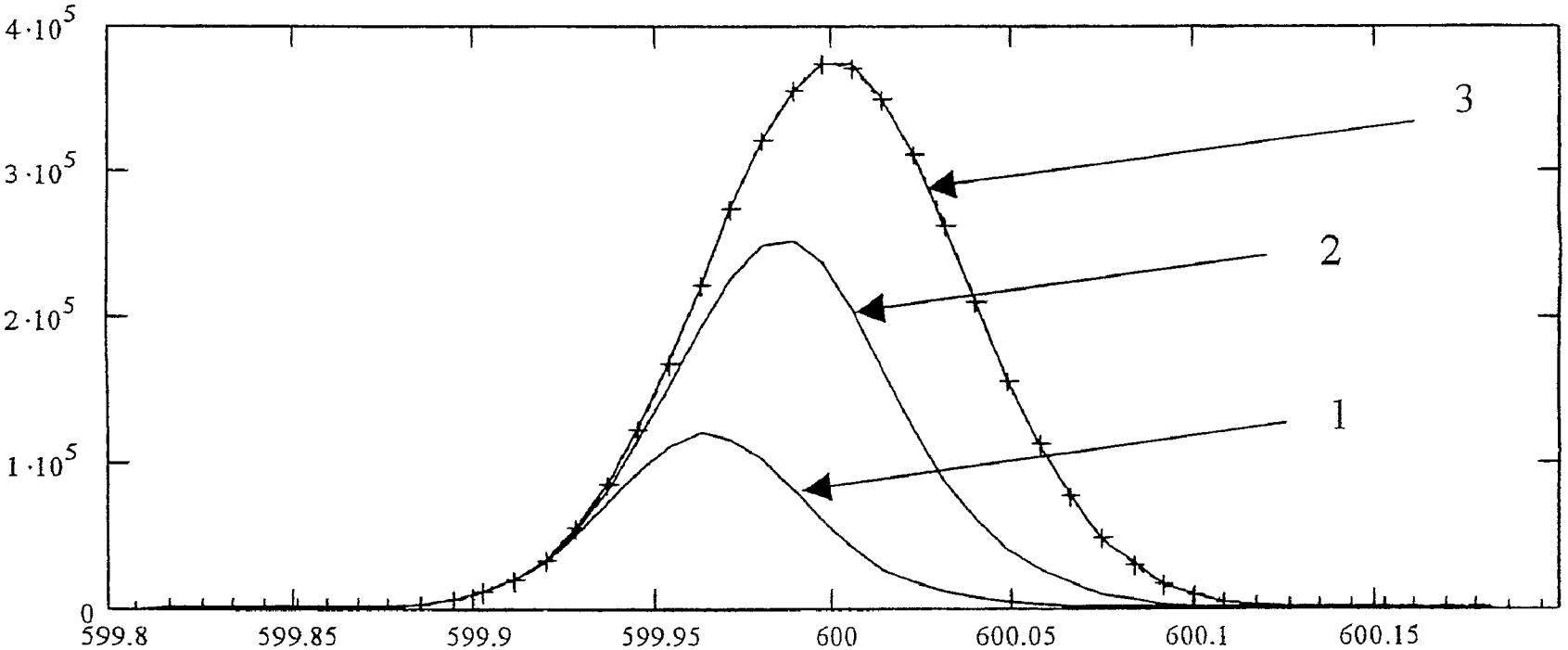
FIG. 6 shows simulated Time of Flight data relating to a single mass spectral peak having a mass to charge ratio of 600, a corresponding peak as corrected according to a conventional correction method and a corresponding peak as corrected according to the preferred embodiment.

FIG. 6 shows simulated data relating to a mass spectral peak having a mean mass to charge ratio of 600. The mass spectral peak corresponds to a mean flight time of 34.8 μs and a mass resolution of 7000 Full Width Half Maximum (FWHM). The peak width at half height was 2.5 ns. The histogram shown in FIG. 6 was formed by combining data from $10^6$ separate time of flight spectra or acquisitions with a mean ion arrival rate λ of 4 events per spectra or acquisition within the peak envelope. Deadtime effects were incorporated into the model using a deadtime of 5 ns. The histogram was constructed using a fixed width time bins of 250 ps.

Deadtime correction according to the preferred embodiment was applied to the final histogram by assuming a deadtime of exactly 20 time bins. Deadtime correction according to the known method as described in ORTEC Application note AN57 and Chapter 8 of the ORTEC Modular Pulse-Processing Electronics catalogue was also applied to the final histogram again assuming a deadtime of exactly 20 time bins.

The mass spectral peak labelled as 1 in FIG. 6 corresponds with a mass spectral peak which was modelled as being one which would be experimentally recorded by the mass analyser. The ion counts for each time bin which would have been recorded if the ion detector did not suffer from deadtime effects are indicated by the data points marked with the symbol +.

The mass spectral peak after correction using the known deadtime correction method is labelled as 2. The mass spectral peak after correction according to the preferred embodiment is labelled as 3. It is readily apparent that the method of correction according to the preferred embodiment provides a much better degree of deadtime correction than the known method. It is also apparent that the resulting corrected mass spectral peak labelled as 3 in FIG. 6 correlates very closely with the theoretical data points marked with a +.

Figure 7:
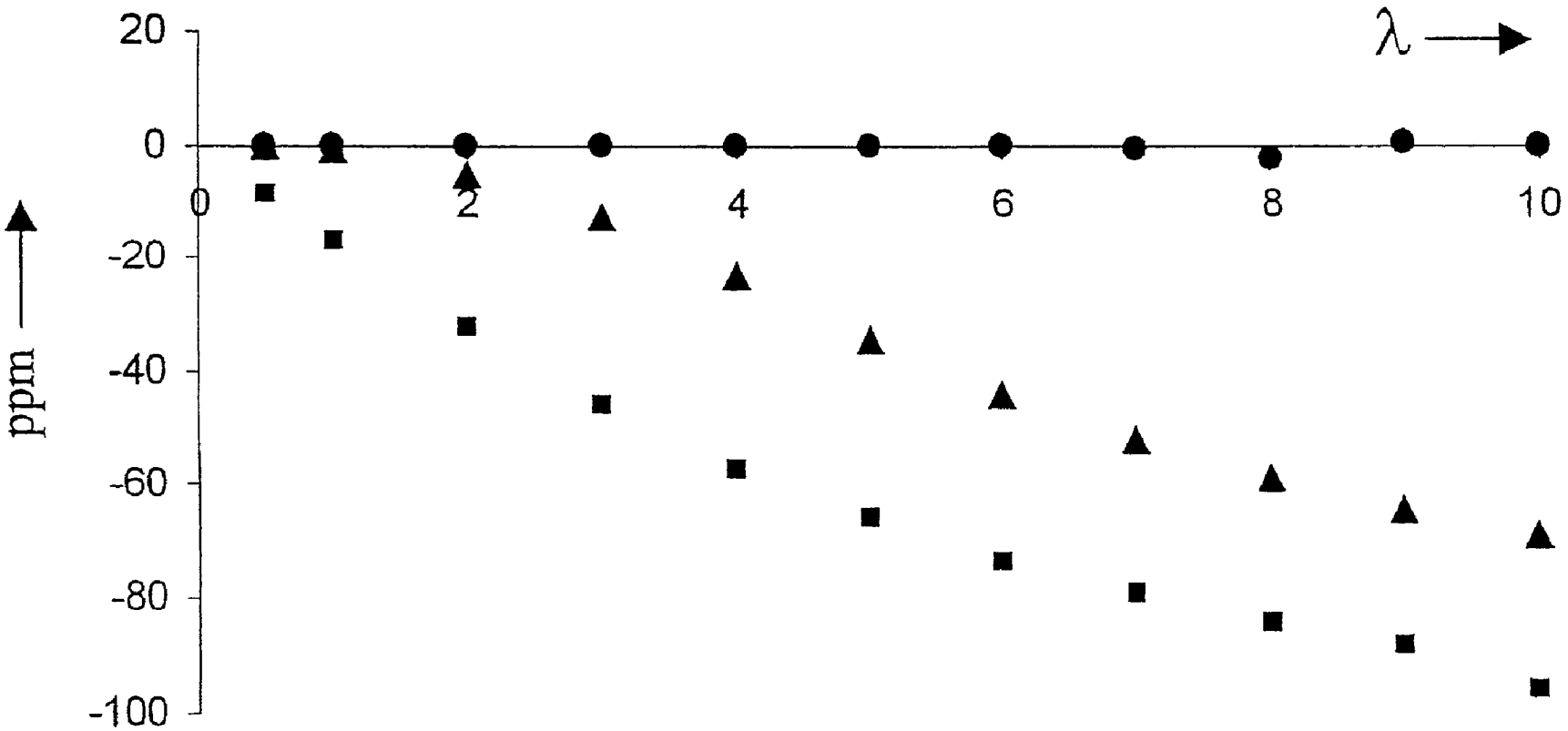
FIG. 7 shows a plot of the ppm error in measured mass to charge ratio verses mean ion arrival rate λ for the simulated peaks shown in FIG. 6.

FIG. 7 shows a graph of the determined ppm error in the mass to charge ratio measured with respect to the mean mass to charge ratio used in the simulation versus the mean ion arrival rate λ. A weighted centroid calculation sometimes referred to as a centre of mass calculation was used to determine the centroid of the peaks.

The data points marked by squares in FIG. 7 represent the ppm error in the mass to charge ratio measured for the distorted peak without correction. The data points marked by triangles represent the ppm error in the mass to charge ratio measured for the peak after correction using the known deadtime correction method. The data points marked by circular dots represent the ppm error in the mass to charge ratio measured for the peak after correction with the deadtime correction method according to the preferred embodiment. All the errors after deadtime correction by the method according to the preferred embodiment are within 0.25 ppm.

Figure 8:
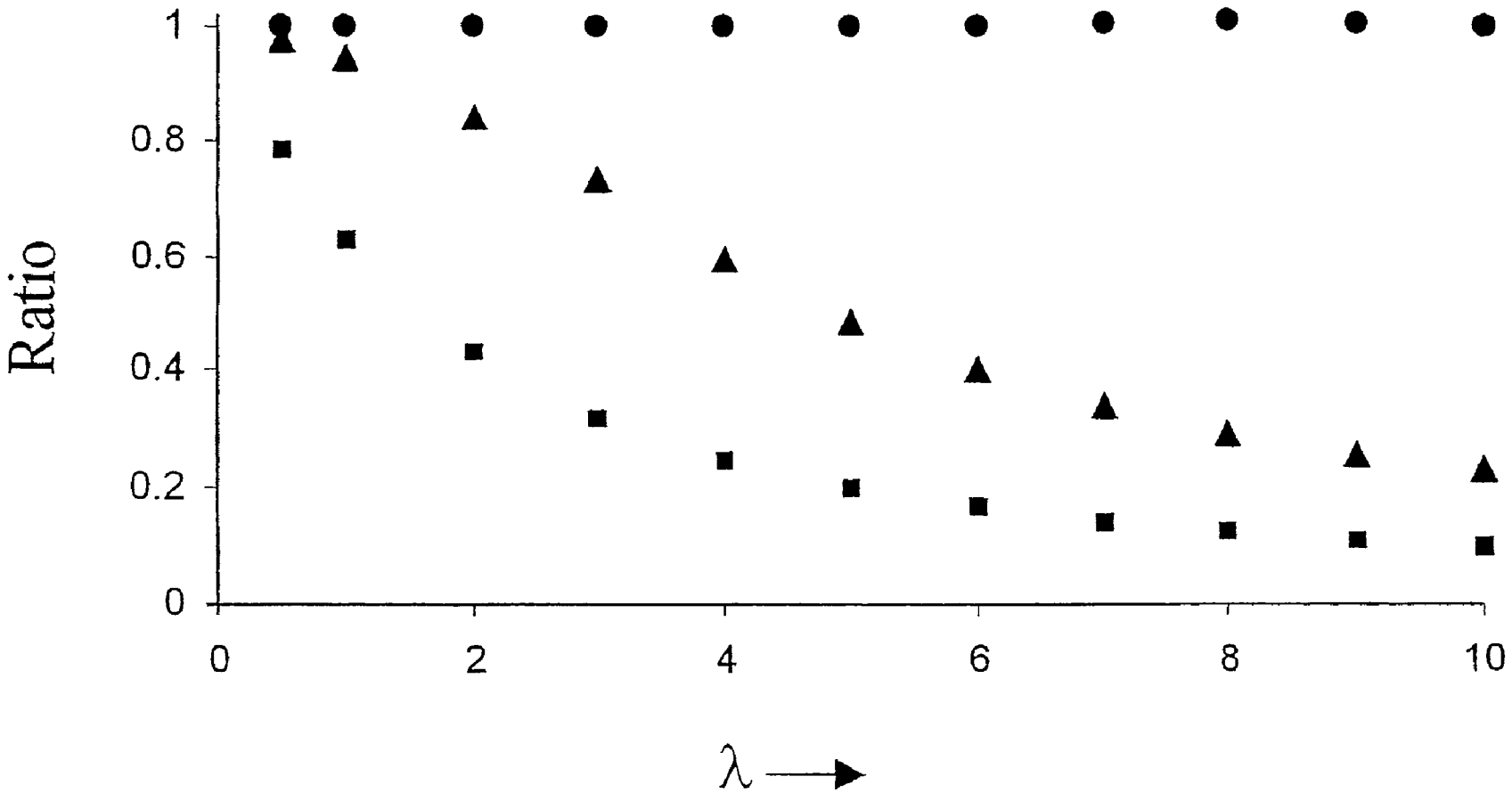
FIG. 8 shows a plot of the ratio of simulated peak area to undistorted peak area verses mean ion arrival rate λ for the simulated peaks shown in FIG. 6.

FIG. 8 shows the ratio of the area of the simulated peak after deadtime correction to peak area resulting from the simulation with the deadtime set to zero (i.e. no losses due to deadtime effect) versus ion event arrival rate λ. The data points marked by squares represent the ratio measured for the distorted peak without correction. The data points marked by triangles represent the ratio measured for the peak after correction with the known deadtime correction method. The data points marked by circular dots represent the ratio measured for the peak after correction with the deadtime correction method according to the preferred embodiment. The corrected area using the method according to the preferred embodiment is within 0.3% of the area of the peak with no deadtime losses.

The same model as described above was then extended to include three separate arrival time distributions corresponding to simulated mass spectral peaks having mean mass to charge values of 600, 600.2 and 600.4 again with a mass resolution of 7000 FWHM. The same conditions for deadtime distortion and histogramming were applied as described above. The combined data was then subjected to the known method of deadtime correction and the method of deadtime correction according to the preferred embodiment.

Figure 9:
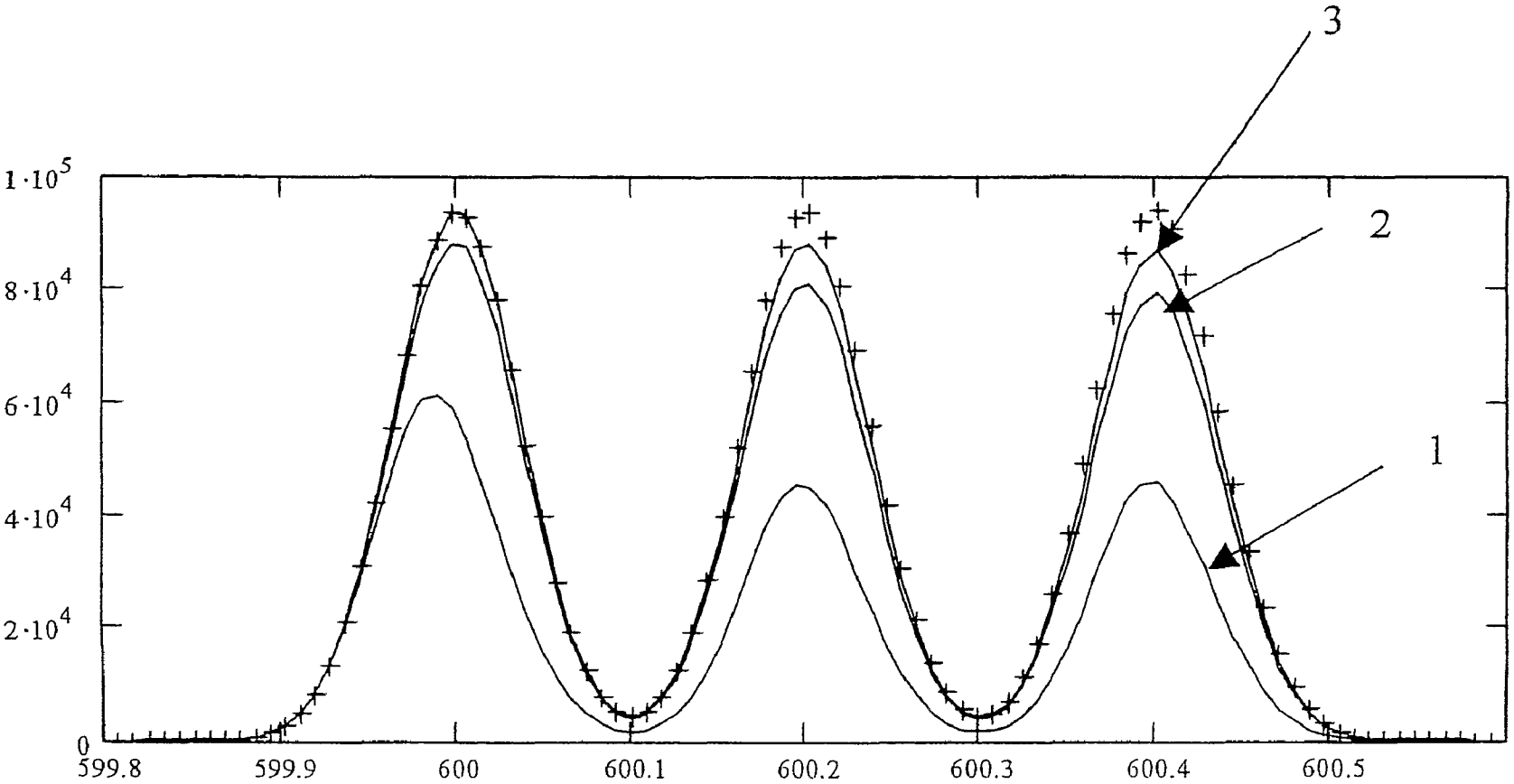
FIG. 9 shows simulated Time of Flight data relating to three mass spectral peaks having mass to charge ratios of 600.0, 600.2 and 600.4 with a mean ion arrival rate λ of 1, corresponding peaks as corrected according to the conventional correction method and corresponding peaks as corrected according to the preferred embodiment.

FIG. 9 shows a histogram produced from a simulation of the three peaks each having a mean ion arrival event rate λ of 1 event per spectrum per peak. The deadtime distorted mass spectral peaks as would be experimentally observed are shown in FIG. 9 and are labelled as 1. The theoretical peaks if the deadtime was set to zero are indicated by the data points marked with the symbol +. The peaks after correction using the known deadtime correction method are labelled as 2. The peaks after correction with the method of deadtime correction according to the preferred embodiment are labelled as 3. It is apparent from FIG. 9 that although both the known method and the method according to the preferred embodiment result in insufficient deadline correction for the second and third peaks, nonetheless a superior level of correction is afforded by the deadtime correction method according to the preferred embodiment.

Figure 10:
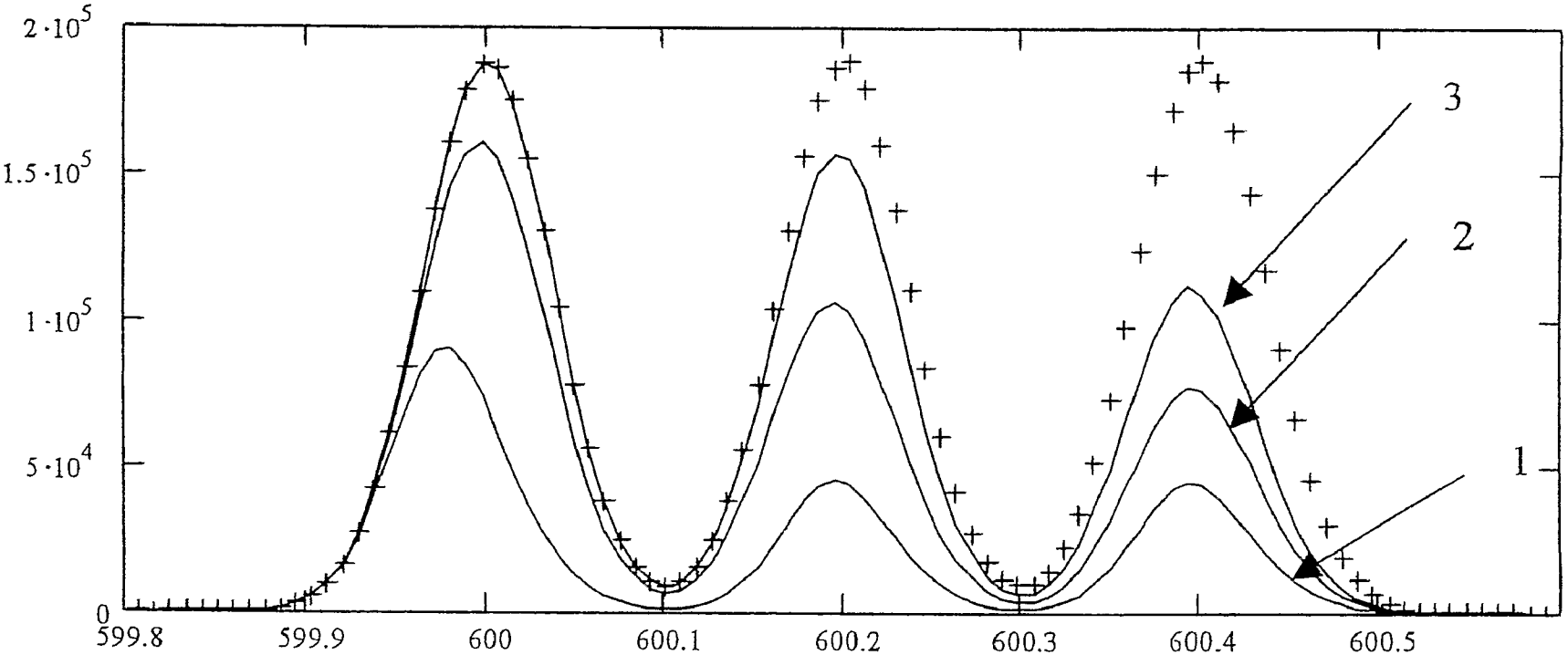
FIG. 10 shows simulated Time of Flight data relating to three mass spectral peaks having mass to charge ratios of 600.0, 600.2 and 600.4 with a mean ion arrival rate λ of 2, corresponding peaks as corrected according to the conventional correction method and corresponding peaks as corrected according to the preferred embodiment.

FIG. 10 shows a histogram produced from a simulation of three peaks each having a mean ion event rate λ of 2 events per spectrum per peak. The deadtime distorted mass spectral peaks as would be experimentally observed are labelled as 1. The theoretical peaks if the deadtime was set to zero are indicated by the data points marked with the symbol +. The peaks after correction using the known deadtime correction method are labelled as 2. The peaks after correction with the method of deadtime correction according to the preferred embodiment are labelled as 3. It is apparent from FIG. 10 that although both the known method and the method according to the preferred embodiment result in insufficient correction for losses due to deadtime for the second and third peaks, nonetheless a superior level of correction is afforded by the deadtime correction method according to the preferred embodiment.

The deadtime correction method according to the preferred embodiment assumes that the deadtime is an exact number of digitiser time bins. However, in practice the actual or exact deadtime of the system may be a non-integer number of time bins. The error in the correction due to the extending deadtime of preceding peaks, as illustrated in FIGS. 9 and 10, can in some part be attributed to this initial assumption.

Embodiments of the present invention are also contemplated wherein the deadtime of the system may be taken as being a non-integer number of time bins corresponding to the sampling rate of the Time to Digital Converter.

According to a further embodiment of the present invention the preferred method of deadtime correction is extended so as to include a further correction based upon the statistical distribution of events in time bin j=i−(x+1) which may result in deadtime losses in the time bin to be corrected i.

This effect may also be reduced by increasing the digitisation rate of the Time to Digital Converter thereby reducing the width Δt of individual time bins.

The method disclosed can also be applied to non-extending deadtime effects. Using an analogous approach an expression for the correction of ion arrival events due to non-extending deadtime effects can be formulated and may be given by:

$$Q_i = -\ln\left[1 - \frac{q_i}{\left(1 - \sum_{j=i-x}^{i-1} \frac{q_j}{N}\right) \cdot N}\right] \cdot N \tag{13}$$

Although the present invention has been described with reference to the preferred embodiments, it will be understood by those skilled in the art that various changes in form and detail may be made to the particular embodiments discussed above with departing from the scope of the invention as set forth in the accompanying claims.

The invention claimed is:

1. A method of mass spectrometry comprising:

(a) acquiring a plurality of sets of mass spectral data wherein ion arrival events are recorded in one or more bins;

(b) summing, combining or histogramming N sets of mass spectral data to form a composite set of data; and (c) at least partially correcting for deadtime effects by determining or estimating the number of ions $Q_i$ which arrived in an $i^{th}$ bin, wherein:

$$Q_i = -\ln\left[1 - \frac{q_i}{N \cdot e^{-\sum_{j=i-x}^{i-1} \frac{Q_j}{N}}}\right] \cdot N$$

and wherein $q_i$ is the actual total number of ion arrival events recorded in said $i^{th}$ bin and x is an integer corresponding to the number of bins which correspond with an estimated deadtime period.

2. A method as claimed in claim 1, wherein said ion arrival events are recorded in one or more time, mass or mass to charge ratio bins.

3. A method as claimed in claim 1, wherein x is an integer corresponding to the number of time, mass or mass to charge ratio bins which corresponds to an estimated deadtime period.

4. A method as claimed in claim 1, further comprising detecting ions using an ion detector selected from the group consisting of: (i) one or more microchannel plate (MCP) detectors; (ii) one or more discrete dynode electron multipliers; (iii) one or more phosphor, scintillator or photomultiplier detectors; (iv) one or more channeltron electron multipliers; and (v) one or more conversion dynodes.

5. A method as claimed in claim 1, wherein the step of acquiring one or more sets of mass spectral data comprises using a Time to Digital Converter or recorder to determine the time when ions arrive at an ion detector.

6. A method as claimed in claim 1, further comprising the step of ionising a sample using an ion source, wherein said ion source is selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; and (xviii) a Thermospray ion source.

7. A method as claimed in claim 1, wherein said step of summing, combining or histogramming N sets of mass spectral data comprises forming a histogram or mass spectrum of total number of ion counts or ion arrival events versus time, time bins, mass, mass bins, mass to charge ratio or mass to charge ratio bins.

8. A method as claimed in claim 1, wherein the probability of n ions arriving within a single bin within a single acquisition of mass spectral data is given by:

$$P(n) = \frac{e^{-\lambda} \cdot \lambda^n}{n!}$$

wherein n is the total number of ion arrivals in a given bin and λ is the average number of ions arriving in one bin in a final histogrammed spectrum corresponding to N acquisitions.

9. A mass spectrometer comprising:

a mass analyser; and a processing system for processing mass spectral data obtained by said mass analyser, wherein said processing system is arranged and adapted to:

(a) acquire one or more sets of mass spectral data wherein ion arrival events are recorded in one or more bins;

(b) sum, combine or histogram N sets of mass spectral data to form a composite set of data; and (c) at least partially correct for deadtime effects by determining or estimating the number of ions $Q_i$ which arrived in an $i^{th}$ bin, wherein:

$$Q_i = -\ln\left[1 - \frac{q_i}{N \cdot e^{-\sum_{j=i-x}^{i-1} \frac{Q_j}{N}}}\right] \cdot N$$

and wherein $q_i$ is the actual total number of ion arrival events recorded in said $i^{th}$ bin and x is an integer corresponding to the number of bins which corresponds to an estimated deadtime period.

10. A mass spectrometer as claimed in claim 9, wherein said ion arrival events are recorded in one or more time, mass or mass to charge ratio bins.

11. A mass spectrometer as claimed in claim 9, wherein x is an integer corresponding to the number of time, mass or mass to charge ratio bins which corresponds to an estimated deadtime period.

12. A mass spectrometer as claimed in claim 9, wherein said mass analyser comprises a Time of Flight mass analyser.

13. A mass spectrometer as claimed in claim 9, wherein said mass analyser comprises an ion detector.

14. A mass spectrometer as claimed in claim 9, further comprising a Time to Digital Converter.

15. A mass spectrometer as claimed in claim 9, further comprising an ion source.

16. A method of mass spectrometry comprising:

(a) using a detector to acquire a plurality of sets of mass spectral data wherein ion arrival events are recorded in one or more time, mass or mass to charge ratio bins;

(b) summing, combining or histogramming N sets of mass spectral data to form a composite set of data; and (c) at least partially correcting for deadtime effects including correcting extending deadtime effects, said extending deadtime effects resulting from an ion arriving at the detector and triggering a deadtime and another ion subsequently arriving at the detector within this deadtime so as to extend the duration of the deadtime;

wherein the step of at least partially correcting for deadtime effects determines or estimates the number of ions $Q_i$ which arrived in an $i^{th}$ bin, wherein:

$$Q_i = -\ln\left[1 - \frac{q_i}{\left(1 - \sum_{j=i-x}^{i-1} \frac{q_j}{N}\right) \cdot N}\right] \cdot N$$

and wherein $q_i$ is the actual total number of ion arrival events recorded in said $i^{th}$ bin and x is an integer corresponding to the number of time, mass or mass to charge ratio bins which correspond with an estimated deadtime period.

17. A mass spectrometer comprising:

a mass analyser comprising a detector; and a processing system for processing mass spectral data obtained by said mass analyser, wherein said processing system is arranged and adapted to:

(a) acquire one or more sets of mass spectral data, wherein ion arrival events are recorded in one or more time, mass or mass to charge ratio bins;

(b) sum, combine or histogram N sets of mass spectral data to form a composite set of data; and (c) at least partially correcting for deadtime effects including correcting extending deadtime effects, said extending deadtime effects resulting from an ion arriving at the detector and triggering a deadtime and another ion subsequently arriving at the detector within this deadtime so as to extend the duration of the deadtime;

wherein the step of at least partially correcting for deadtime effects determines or estimates the number of ions $Q_i$ which arrived in an $i^{th}$ bin, wherein:

$$Q_i = -\ln\left[1 - \frac{q_i}{\left(1 - \sum_{j=i-x}^{i-1} \frac{q_j}{N}\right) \cdot N}\right] \cdot N$$

and wherein $q_i$ is the actual total number of ion arrival events recorded in said $i^{th}$ bin and x is an integer corresponding to the number of time, mass or mass to charge ratio bins which corresponds to an estimated deadtime period.

* * * * *